United States Patent [19]

Sturzl

[11] Patent Number: 4,764,716

[45] Date of Patent: Aug. 16, 1988

[54] STABILIZING CIRCUIT FOR A MICROCOMPUTER

[75] Inventor: Wilhelm Sturzl, Winkelhaid, Fed. Rep. of Germany

[73] Assignee: Diehl GmbH & Co., Nurnberg, Fed. Rep. of Germany

[21] Appl. No.: 27,864

[22] Filed: Mar. 19, 1987

[30] Foreign Application Priority Data

Apr. 11, 1986 [DE] Fed. Rep. of Germany ..... 3612323

[51] Int. Cl.[4] ..... G05F 1/613

[52] U.S. Cl. ..... 323/231; 323/901

[58] Field of Search ..... 323/231, 299, 312, 313, 323/314, 315, 316, 901; 363/49

[56] References Cited

U.S. PATENT DOCUMENTS

| | | | |
|---|---|---|---|
| 3,344,340 | 9/1967 | Webb | 323/901 X |
| 3,577,062 | 5/1971 | Hoffman | 323/231 X |
| 3,881,150 | 4/1975 | Gay | 323/901 X |
| 4,608,529 | 8/1986 | Mallinson | 323/231 X |
| 4,642,746 | 2/1987 | Lösel | 363/49 |

*Primary Examiner*—Peter S. Wong

*Attorney, Agent, or Firm*—Scully, Scott, Murphy & Presser

[57] ABSTRACT

A stabilizing circuit for the operating voltage of a microcomputer, in which the input of the circuit is connected to a power supply, and the output of the circuit is connected to the operating voltage-input of the microcomputer. Connected in parallel with the operating voltage-input is a first zener diode, and connected in series with the latter is the collector-emitter section of a first transistor, in which this series circuit is arranged in parallel with the circuit input; wherein there is provided a circuit portion which will deliver a base current to the first transistor for connecting-through of the transistor only then, when subsequent to the switching-in of the power supply, a voltage has built up at the circuit input which, in comparison with the voltage rise of the power supply, leads to a rapid rise in the operating voltage; and in which the emitter-collector current of the first transistor is a constant current which divides itself between the microcomputer and the first zener diode, whereby the first zener diode presently conducts that portion of the constant current which is not employed by the microcomputer in conformance with its current load condition.

5 Claims, 1 Drawing Sheet

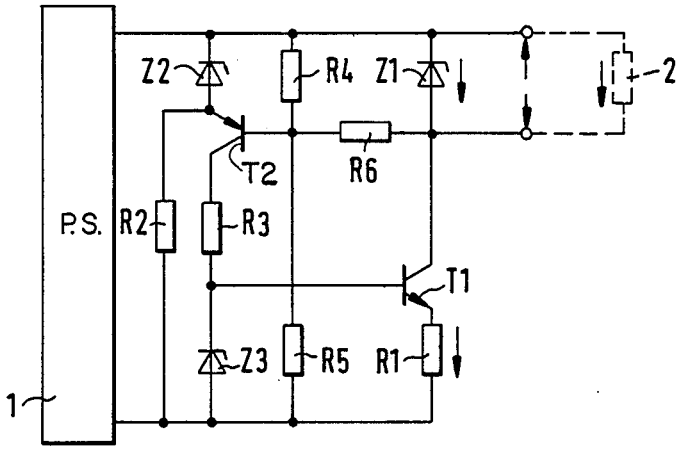
Z2
R4
Z1
2
T2
R6
P.S.
R2
R3
T1
Z3
R5
R1
1

STABILIZING CIRCUIT FOR A MICROCOMPUTER

BACKGROUND OF THE INVENTION

1. Field of the Invention

The present invention relates to a stabilizing circuit for the operating voltage of a microcomputer, in which the input of the circuit is connected to a power supply, and the output of the circuit is connected to the operating voltage-input of the microcomputer.

For microcomputers it is necessary to stabilize the operating voltage. For this purpose, there is provided a stabilizing circuit. Moreover, upon actuation or the switching on of the microcomputer; in essence, at the application of the input voltage, the microcomputer must be brought into a definite starting position. In order to be able to attain the foregoing, it is necessary that the input voltage rises within a predetermined short period of time from zero to the value of the operating voltage. However, at the switching in of a power supply, the output voltage thereof rises substantially slower than required within the necessary period of time. This has as a result that the definite starting position of the microcomputer will not readily adjust itself.

2. Discussion of the Prior Art

In the published literature entitled "Halbleiter-Schaltungstechnik", U.Tietze; Ch. Schenk —5th Revised Edition; Berlin, Heidelberg, New York: Springer 1980, page 384, there is described a circuit for the stabilizing of an input voltage. This circuit operates in a series circuit, and with a constant-current source series circuit and with a zener diode in a parallel circuit relative to the output voltage. A rise in the input voltage which is exceedingly slow cannot be accelerated by this circuit.

SUMMARY OF THE INVENTION

Accordingly, it is an object of the present invention to provide a stabilizing circuit of the above-mentioned type by means of which, under relatively low requirements for circuitry, upon the switching in of the power supply, there can be attained a sufficient steep rise in the operating voltage and, thereafter, its stabilization.

Inventively, the foregoing object is achieved in that a first zener diode is connected in parallel with the operating voltage-input, and connected in series with the zener diode is the collector-emitter section of a first transistor, in which this series circuit is arranged in parallel with the circuit input; wherein there is provided a circuit portion which will deliver a base current to the first transistor for connecting-through of the transistor only then, when subsequent to the switching-in of the power supply, a voltage has built up at the circuit input which, in comparison with the voltage rise of the power supply, leads to a rapid rise in the operating voltage; and in which the emitter-collector current of the first transistor is a constant current which divides itself between the microcomputer and the first zener diode, whereby the first zener diode presently conducts that portion of the constant current which is not employed by the microcomputer in conformance with its current load condition.

As a consequence thereof, obtained is a circuit which assumes two functions; namely, the desired, rapid rise in the operating voltage upon the switching in and the stabilizing of the operating voltage. Through the combination of the two functions in one circuit, there is only a minor demand on components for their circuit.

BRIEF DESCRIPTION OF THE DRAWING

Reference may now be had to the following detailed description of advantageous embodiments of the invention, taken in conjunction with the accompanying single FIGURE of the drawing illustrating a block circuit diagram of an inventive stabilizing circuit.

DETAILED DESCRIPTION

The circuit is connected AT one side to the output of an unstabilized power supply 1, and at the other side to the operating voltage-input of a microcomputer 2.

Connected in parallel with the operating voltage-input of the microcomputer 2 is a first zener diode Z1. Connected in series with the latter is the collector-emitter section of a first transistor T1. An emitter impedance R1 is connected to the emitter of the transistor. This series circuit is connected in parallel with the output of the power supply 1.

Also connected in parallel with the output of the power supply 1 is the series circuit comprising an impedance R2 and a second zener diode Z2. In parallel with the impedance R1, the emitter-collector section of a second transistor T2 is connected in series with an impedance R3 and a further zener diode Z3. Between the impedance R3 and the zener diode Z3 there is connected the base of the transistor T1.

The base of the transistor T2 is connected to a voltage divider constituted of impedances R4, R5, which is also located in parallel with the output of the power supply 1.

Connected between the collector of the transistor T1 and the base of the transistor T2 is a positive feedback impedance R6.

The manner of operation of the above-described circuit is substantially as described hereinbelow:

When the power supply 1 is switched in, the output voltage thereof then builds up slowly. Through the impedance R2, the emitter of the transistor T2 follows this voltage sequence or gradient, until there has been reached the zener voltage of the zener diode Z2. The emitter of the transistor T2 is then maintained at the zener voltage.

Through the voltage divider R4, R5, the transistor T2 is initially maintained blocked, until the output voltage of the power supply 1 has reached a value at which the transistor T2 is rendered conductive. Through the impedance R3, the transistor T1 is then imparted a base current. The zener diode Z3 maintains the base voltage constant in cooperation with the impedance R1. The transistor T1 is now conductive or electrically-transmissive, and a constant current flows across its collector-emitter section. This constant current is a combination from the zener current of the zener diode Z1 and the current flowing through the microcomputer 2. The zener current flowing through the zener diode Z1 is presently equal to the difference between the constant current and the current which is necessitated by the present operating condition or need of the microcomputer 2.

In that the transistor T1, upon the switching in of the power supply 1, is only activated in a delayed mode when the output voltage of the power supply 1 has reached an adequate value, there is attainable the desired steep voltage rise in the operating voltage of the microcomputer 2, such that the latter, upon being switched in, is brought into its defined starting position. Moreover, the zener diode Z1 in cooperation with the constant current of the transistor T2, leads to the necessary stabilizing of the voltage during the operation of the microcomputer 2.

By means of the positive feedback impedance R6 there is attained a hysteresis of the circuit.

What is claimed is:

1. In a stabilizing circuit for an operating voltage of a microcomputer, wherein an input of the circuit is connected to a power supply and an output of the circuit to an operating voltage input of the microcomputer; the improvement comprising: a first zener diode being connected in parallel with the operating voltage input; a first transistor having an emitter, a collector and a base, the collector and emitter of the first transistor being connected in series with said zener diode, said series circuit being connected in parallel with the circuit input; a circuit portion for delivering a base current to said first transistor for rendering said first transistor transmissive only in response to the power supply being energized which causes a voltage to be built up at the input of said circuit which leads to a rapid rise in the operating voltage in comparison with a rise in the output voltage of the power supply, and wherein an emitter-collector current of said first transistor is a constant current which divides itself between the microcomputer and the first zener diode, wherein the first zener diode presently conveys the portion of the constant current which is not employed by the microcomputer in conformance with its present load condition.

2. A stabilizing circuit as claimed in claim 1, wherein said circuit portion comprises a second transistor having an emitter, a collector and a base; a second zener diode being connected to said emitter, and a voltage divider being connected to said base such that said second transistor becomes transmissive only when the output voltage of the power supply has risen subsequent to energization thereof, and wherein the collector of said second transistor is connected through an impedance with the base of said first transistor.

3. A stabilizing circuit as claimed in claim 1, wherein an emitter impedance is connected to the first transistor, and a third zener diode is connected to the base of said first transistor for maintaining the base voltage of said first transistor constant.

4. A stabilizing circuit as claimed in claim 2, wherein the emitter of said second transistor is connected to a voltage divider constituted of a second zener diode and a further impedance.

5. A stabilizing circuit as claimed in claim 2, wherein a feedback impedance is connected between the collector of said first transistor and the base of said second transistor.

* * * * *